United States Patent [19]

Locher

[11] Patent Number: 4,828,080

[45] Date of Patent: May 9, 1989

[54] ADJUSTING MECHANISM, PARTICULARLY FOR TILTABLE AND VERTICALLY ADJUSTABLE CHAIRS

[75] Inventor: Hermann Locher, Dornach, Switzerland

[73] Assignee: Giroflex Entwicklungs AG, Koblenz, Switzerland

[21] Appl. No.: 100,606

[22] Filed: Sep. 24, 1987

Related U.S. Application Data

[63] Continuation of Ser. No. 795,500, Nov. 6, 1985, abandoned.

[30] Foreign Application Priority Data

Nov. 9, 1984 [CH] Switzerland ..... 5 392/84

[51] Int. Cl.[4] ..... F16F 9/32

[52] U.S. Cl. ..... 188/300; 248/161; 267/64.12; 267/131; 267/226

[58] Field of Search ..... 267/64.12, 34, 131, 267/195, 221, 223, 226, 120; 188/300, 297; 248/161, 411; 297/300, 301

[56] References Cited

U.S. PATENT DOCUMENTS 2,453,855 11/1948 Oliver ..... 188/300

3,177,980 4/1965 Porter ..... 188/300

3,236,515 2/1966 Ackerman ..... 188/300

*Primary Examiner*—Andres Kashnikow

*Assistant Examiner*—Matthew C. Graham

*Attorney, Agent, or Firm*—Werner W. Kleeman

[57] ABSTRACT

The adjusting mechanism is used for exerting a force on two components moveable relative to one another and comprises a cylinder, a piston and a piston rod. A guide rod is also provided on the piston and is guided in a guide connection of a bottom cylinder casting. A control piston is displaceably guided in a longitudinal bore of the piston and in a further longitudinal bore of the guide rod. The piston contains transfer ducts, which are either obturated by the control piston or are freed or exposed by a smaller diameter portion of the control piston. An inner cylinder chamber is completely filled with a flowable or fluid grease. As a result, the piston rod can be locked in position by the control piston closing the transfer ducts and, on releasing or opening the latter, the piston rod can be moved. The locking of the adjusting mechanism in a specific position, as is particularly required in the case of tiltable chairs, is consequently facilitated in comparison to known adjusting mechanisms. In addition, by using flowable grease, the sealing of the adjusting mechanism is made simpler.

9 Claims, 1 Drawing Sheet

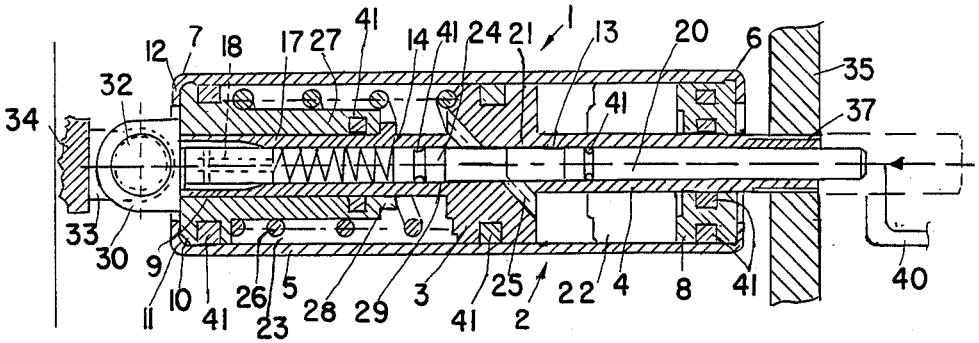
FIG. 1.
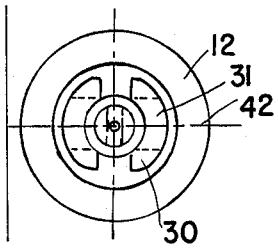
FIG. 2.
FIG. 3.
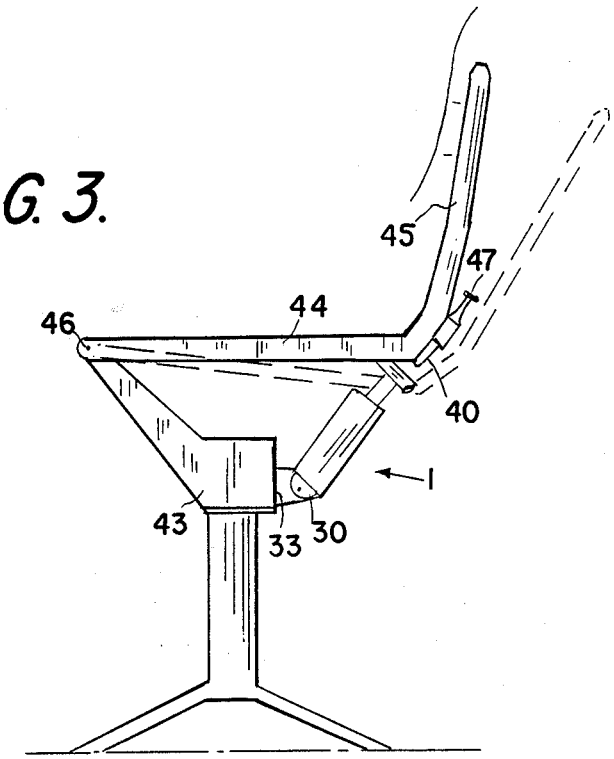

ADJUSTING MECHANISM, PARTICULARLY FOR TILTABLE AND VERTICALLY ADJUSTABLE CHAIRS

CROSS-REFERENCE TO RELATED APPLICATIONS

This application is a continuation of my commonly assigned, copending U.S. patent application Ser. No. 06/795,500, filed Nov. 6, 1985 and entitled "ADJUSTING MECHANISM, PARTICULARLY FOR TILTABLE AND VERTICALLY ADJUSTABLE CHAIRS" now abandoned which in turn is related to my co-pending U.S. patent application Ser. No. 652,496, filed Sep. 19, 1984, and entitled "CHAIR WITH SWIVELLING SEAT AND BACKREST PORTIONS", now U.S. Pat. No. 4,668,012, granted May 26, 1987, and to my co-pending U.S. patent application Ser. No. 780,825, filed Sep. 27, 1985 and entitled "CHAIR WITH REARWARDLY INCLINABLE SEAT AND BACKREST CARRIER", now U.S. Pat. No. 4,684,173, granted Aug. 4, 1987.

BACKGROUND OF THE INVENTION

The present invention broadly relates to adjustable chairs and, more specifically, pertains to a new and improved construction of an adjusting mechanism for a tiltable and vertically adjustable chair.

Generally speaking, the adjusting mechanism of the present invention serves for exerting a force on two components movable relative to one another and relates in particular to adjustable chairs comprising a cylinder and a piston displaceably guided therein with a piston rod conducted out of one front face of the cylinder, the piston subdividing the inner chamber of the cylinder into two partial cylinder chambers which are interconnected by at least one duct and are filled with a fluid medium.

In other words, the adjusting mechanism for exerting a force on first and second components moveable in relation to one another comprises a cylinder having a front face and defining an inner chamber, a piston displaceably guided in the cylinder and having a piston rod conducted out through the front face of the cylinder, the piston subdividing the inner chamber of the cylinder into two partial cylinder chambers, and there being further provided at least one transfer or locking duct interconnecting the two partial cylinder chambers. The two partial cylinder chambers are filled with a fluid medium.

Numerous different constructions of adjusting mechanisms of the aforementioned type are known and these are used in various different ways. A widely known construction of such an adjusting mechanism is constituted by the conventional gas spring. In its simplest construction, it comprises a cylinder, a piston guided therein and a piston rod connected to the piston. The inner chamber of the cylinder is filled with a fluid or flowable medium, e.g. a gas, which is under a certain pressure. The gas spring is arranged between two components movable towards one another, the cylinder being supported on one component and the piston rod on the other. In order to attain elastic or spring properties, the compressibility of the gas is exploited, the pressure in the cylinder rising approximately linearly when compressing the gas in the cylinder chamber. The gas spring is a relatively simple device, but high demands are made on the precision of its manufacture in order that the escape of gas on the surfaces movable relative to one another be as small as possible.

Another known type of adjustment device is constituted by the conventional shock absorber. The construction of a shock absorber is substantially the same as that of a gas spring, but oil or liquid is used as the fluid medium. A restricted channel or duct is provided in the piston and the oil is forced through the channel or duct during a relative movement of cylinder and piston and consequently the movement of the two parts is retarded, i.e. a damping or cushioning takes place.

One known use of the gas spring is in chairs with an adjustable seat or an adjustable back, or both. The function of the gas spring is to exert an opposing force on the seat or back, or both, when passing from the normal sitting position into a reclined or relaxed position and for elastically returning the chair to its normal position again.

However, it is also desirable for the chair to be fixable in an arbitrary position. To this end, corresponding devices are known in connection with the gas spring which enable the latter to be locked in specific positions. It is mainly due to the fluid medium or gas that it is difficult to lock the chair in a given position.

SUMMARY OF THE INVENTION

Therefore, with the foregoing in mind, it is a primary object of the present invention to provide a new and improved construction of an adjusting mechanism which does not exhibit the aforementioned drawbacks and shortcomings of the prior art constructions.

Another and more specific object of the present invention aims at providing a new and improved construction of an adjusting mechanism of the aforementioned type in which fluid medium losses are reliably prevented while permitting simple locking in a desired position.

Yet a further significant object of the present invention aims at providing a new and improved construction of an adjusting mechanism of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the adjusting mechanism of the present invention is manifested by the features that a force or biasing spring acting on the cylinder and the piston is arranged in one of the partial cylinder chambers and one end of the forced or biasing spring is supported on one of the two bottom cylinder castings or cylinder caps or bottoms while the other end is supported on the piston.

In other words, the adjusting mechanism of the present invention is manifested by the features that it comprises force or biasing spring means arranged in one of the partial cylinder chambers and two bottom cylinder castings or cylinder caps. The biasing spring means has a first end and a second end. The first end of the biasing spring means is supported on one of the two bottom cylinder castings or caps while the second end of the biasing spring means is supported on the piston. The biasing spring means acts upon the cylinder and the piston rod through the piston.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIG. 1 schematically shows a longitudinal section through an adjusting mechanism according to the invention with its control system;

FIG. 2 schematically shows a view of that front face of the cylinder which is located on the side of the adjusting mechanism remote from the piston rod according to FIG. 1; and FIG. 3 schematically shows a diagrammatic view of an application of the adjusting mechanism according to FIG. 1 in a chair having an adjustable seat and an adjustable back.

BRIEF DESCRIPTION OF THE PREFERRED EMBODIMENTS

Describing now the drawings, it is to be understood that to simplify the showing thereof only enough of the structure of the adjusting mechanism has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a cylinder 2 and a piston 3 having a piston rod 4. The cylinder 2 has a cylinder tube or tubular body 5 which is closed at each of its ends 6 and 7 by respective bottom cylinder castings or bottom caps 8 and 9. These bottom cylinder caps 8 and 9 are each peripherally provided with a projection or outer flange 10 which fits into an annular groove or offset portion 11 at the ends 6 and 7 of the cylinder tube 5. In order that the bottom cylinder caps 8 and 9 be secured in this position, the ends 6 and 7 of the cylinder tube or tubular body 5 are constructed with a bead or inner flange 12. By means of the projection or outer flange 10 and the offset portion or annular groove 11, the bottom cylinder castings 8 and 9 are fixed in position, while the bead or inner flange 12 is responsible for positive fixation of the bottom cylinder caps 8 and 9.

The piston 3 and the piston rod 4 have a first longitudinal bore 13 which, on the side remote from the piston rod 4, passes into a second longitudinal bore 14 with a somewhat larger diameter than that of the first longitudinal bore 13. The second longitudinal bore 14 is located within a guide rod 17 which is fixed to the piston 3 and which is terminated at its other end by a screw plug 18.

A control piston 20 is displaceably guided in the first longitudinal bore 13. The control piston 20 has a cylindrical portion 21 having a smaller diameter than the diameter of the first longitudinal bore 13.

The piston 3 subdivides the inner chamber of the cylinder 2 into two partial cylinder chambers 22 and 23 which can be interconnected by means of two locking ducts or transfer ducts 25 in the piston 3, as will be explained hereinafter. The two transfer or locking ducts 25 each slope from a respective one of the partial cylinder chambers 22 and 23 into the first longitudinal bore 13, but do not normally flow communicate with one another in the latter. Interconnection is rendered possible only if the cylindrical portion 21 of the control piston 20 having the smaller diameter is located in the vicinity of the openings or mouths of the ducts 25 into the longitudinal bore 13.

A strong force or biasing spring 26 is inserted in the partial cylinder chamber 23 remote from the piston rod 4. One end of the biasing spring 26 is supported on the bottom cylinder cap 9 and the other end is supported on the piston 3. The biasing spring 26 supplies the requisite spring force for operating the adjusting mechanism 1. A guide connection 27 is placed on the bottom cylinder cap 9 for the biasing spring 26.

A further spring 28 is inserted in the second longitudinal bore 14 of the guide rod 17 and one end thereof is supported on the screw plug 18, while the other end thereof is supported on the front face of the cylindrical portion 24 of the control piston 20. The function of the further spring 28 is to force the larger diameter cylindrical portion 24 against a shoulder formed at the transition from the first longitudinal bore 13 into the second longitudinal bore 14.

As can be seen in FIG. 2, two tongues 30 are provided on the bottom cylinder cap 9, through whose bore 31 a bolt 32 is inserted, which secures a further tongue 33 of a first component 34 inserted between the tongues 30. The adjusting mechanism 1 is arranged between the first component 34 and a second component 35 movable with respect to the first component 34. The second component 35 is e.g. a portion of a web to which the piston rod 4 is connected by means of a screw connection 37.

The entire inner chamber of the cylinder 2, i.e. the partial cylinder chambers 22 and 23 and the transfer or locking ducts 25 in the piston 3 are filled with a fluid medium. The fluid medium can be a so-called fluid grease, e.g. Shell OSSAGOL V or a similar suitable grease. It is essential that the fluid medium remain flowable within a wide temperature range of e.g. −30° C. to +70° C., i.e. that it not form droplets.

The adjusting mechanism 1 functions as follows. In FIG. 1, the control piston 20 is shown in its end position, in which the transfer ducts 25 in the piston 3 are obturated. Since the entire inner cylinder chamber is filled with the fluid medium and the latter is substantially incompressible, the adjusting mechanism 1 is locked, i.e. no movement of the piston 3 is possible. If the control piston 20 is now moved by an external control element 40 counter to the force or action of the further spring 28, the locking ducts or transfer ducts 25 are interconnected by the smaller diameter cylindrical portion 21. It is now possible for the first and second components 34 and 35 to be moved in relation to one another, said movement either being aided or inhibited by the strong biasing spring 26.

FIG. 1 shows that packings or seals are provided at various points and are used to ensure a completely satisfactory sealing of the inner chamber of the cylinder 2. The packings 41 preferably comprise one or more different forms of soft packings, e.g. O-rings, lip-type packings and packing rings. Since a fluid grease is used, the sealing effect can be achieved without difficulty even in the case of components moved in relation to one another, e.g. between the control piston 20 and the piston 3, or between the piston rod 4 and the bottom cylinder cap 8. A bore 42 in the screw plug 18 connects the second longitudinal bore 14 to ambient air.

FIG. 3 shows an application of an adjusting mechanism 1 according to the invention on an adjustable chair. A seat with a back 45 is pivotably mounted about a joint 46 on a pedestal 43. The seat 44 and the back 45 are both supported by one end of the adjusting mechanism 1, while the other end is supported by the tongue connection 30 and 33 on the pedestal 43. The external control element 40 acting on the control piston 20 can be adjusted by an actuating device 47, e.g. a screw spindle in such a way that, on the one hand, the adjusting mechanism 1 is locked or, on the other hand, transfer into another chair position is enabled. When the desired chair position has been reached, it is possible to completely satisfactorily lock it in this position. It will be appreciated that the transfer ducts 25 and the control piston 20 cooperate or coact with one another such that even in the presence of sudden shocks to the adjusting mechanism 1 there is not interrupted the positive obturation of the transfer ducts 25 by the control piston 20 without manual operation of the adjusting mechanism. The actuating device 47 can obviously also be provided at some other point, so that it can be effortlessly operated by the person sitting on the chair. The adjusting mechanism 1 can also be located at a different point on the chair, e.g. if the swivel joint 46 is not located in the knee region of the chair user.

Other arrangements of the aforementioned adjusting mechanism 1 can e.g. be gathered from the commonly assigned U.S. Pat. No. 4,502,729 granted Mar. 5, 1985, the aforementioned U.S. patent application Ser. No. 6/652,496, filed Sept. 19, 1984, now U.S. Pat. No. 4,668,012, and the aforementioned U.S. patent application Ser. No. 06,780,825, filed Sept. 23, 1985, now U.S. Pat. No. 4,684,173. The gas springs provided therein can be easily replaced by the aforementioned adjusting mechanism 1. In the case of the chair designs described in these patents, the seat and back are movable relative to one another. However, the requisite vertical adjustability can also be effortlessly obtained with the adjusting mechanism 1, since it is continuously adjustable. In comparison to a conventional gas spring, the adjusting mechanism 1 has the advantage that it is a system without an elevated internal pressure and with correspondingly reduced sealing problems.

It is particularly advantageous that the spring 26 is arranged in the partial cylinder chamber 23. The guide connection 27 extending from the cylinder bottom cap 9 into the partial chamber 23 as a guide for the strong biasing spring 26 diminishes the volume of the partial chamber 23 (lesser quantity of fluid grease) and avoids extending the guide rod 17 out through the cylinder bottom cap 9, while simultaneously maintaining a constant volume in the cylinder 2, provided that the diameters of the piston rod 4 and the guide rod 17 are the same size. As a result, a compact embodiment of the adjusting mechanism 1 is obtained, since essential components are arranged within the cylinder 2.

While there are shown and described present preferred embodiments of the invention, it is to be distinctly understood that the invention is not limited thereto, but may be otherwise variously embodied and practiced within the scope of the following claims. Accordingly,

What I claim is:

1. An adjusting mechanism for exerting a force on first and second components movable in relation to one another, especially in an adjustable chair, comprising:

a cylinder having a front face and defining an inner chamber;

a piston displaceably guided in said cylinder and having a piston rod conducted out through said front face of said cylinder;

said piston rod being operatively connected with one of the two relatively movable components which is movable in opposite directions of movement;

said piston subdividing said inner chamber of said cylinder into two partial cylinder chambers;

transfer duct means interconnecting said two partial cylinder chambers;

said two partial cylinder chambers being filled with a fluid medium;

a control piston member intersecting said transfer duct means for positive obturation of said transfer duct means and for selectively controllable manual only interruption of said positive obturation;

said control piston member enabling said positive obturation of said transfer duct means independent of the direction of movement of said one relatively movable component which is movable in said opposite directions of movement;

biasing spring means being arranged in one of said partial cylinder chambers;

two cylinder caps provided for opposite ends of the cylinder;

said biasing spring means having a first end and a second end;

said first end of said biasing spring means being supported on one of said two cylinder caps;

said second end of said biasing spring means being supported on said piston; and said biasing spring means acting on said cylinder and on said piston;

whereby said transfer duct means and said control piston member cooperate so that sudden shocks to said adjusting mechanism do not interrupt the positive obturation of said transfer duct means without manual operation of said adjusting mechanism.

2. The adjusting mechanism as defined in claim 1, further including:

a first longitudinal bore provided in said piston and said piston rod for displaceably guiding said control piston member therein.

3. The adjusting mechanism as defined in claim 2, further including:

further spring means bearing on said control piston member;

said piston having a side remote from said piston rod;

said piston having a guide rod on said side remote from said piston rod; and said guide rod being provided with a second longitudinal bore for accommodating said further spring means and coaxial with said first longitudinal bore.

4. The adjusting mechanism as defined in claim 3, wherein:

said second longitudinal bore has a larger diameter than said first longitudinal bore;

said control piston member having a predetermined end; and said control piston member having at said predetermined end a substantially cylindrical portion corresponding to said larger diameter for serving as a first stop means for said control piston member.

5. The adjusting mechanism as defined in claim 4, further including:

second stop means arranged at an inner end of said second longitudinal bore; and said second stop means of said second longitudinal bore defining a position of said control piston member in which said transfer duct means interconnecting said two partial cylinder chambers is obturated by said control piston member.

6. The adjusting mechanism as defined in claim 4, wherein: p1 said piston contains sloping ducts defining said transfer duct means;

said transfer duct means having an inclined orientation;

said transfer duct means comprising two inclined ducts;

said two inclined ducts each flow communicating with a respective one of said two partial cylinder chambers;

said first longitudinal bore forming an interconnection for said two inclined ducts; and said cylindrical portion of said control piston member having a smaller diameter than that of said first longitudinal bore for constricting said interconnection.

7. The adjusting mechanism as defined in claim 1, wherein:

one cap of said two cylinder caps is positioned remote from said piston rod;

a guide connection for guiding said biasing spring means being provided on said cap; and said one cap being provided with a second longitudinal bore aligned with said first longitudinal bore for guiding said guide rod of said piston.

8. The adjusting mechanism as defined in claim 1, wherein:

said two partial cylinder chambers are filled with a flowable grease.

9. The adjusting mechanism as defined in claim 1, wherein:

said cylinder comprises a tubular body and said two cylinder caps;

said tubular body having two internal grooves;

said tubular body having two ends and an inner flange at each of said two ends;

each said cap having an outer flange; and each cap of said two cylinder caps being positively fixed by said outer flange fitting into an associated one of said two internal grooves of said tubular body and by said inner flange of said ends.

* * * * *